US007973001B2

(12) United States Patent
Fujita et al.

(10) Patent No.: US 7,973,001 B2
(45) Date of Patent: Jul. 5, 2011

(54) LUBRICANT COMPOSITION

(75) Inventors: Hiroshi Fujita, Ichihara (JP); Yutaka Takakura, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 12/527,881

(22) PCT Filed: Dec. 18, 2007

(86) PCT No.: PCT/JP2007/074298

§ 371 (c)(1),
(2), (4) Date: Aug. 20, 2009

(87) PCT Pub. No.: WO2008/105128

PCT Pub. Date: Sep. 4, 2008

(65) Prior Publication Data

US 2010/0048440 A1 Feb. 25, 2010

(30) Foreign Application Priority Data

Feb. 26, 2007 (JP) ..... 2007-046309

(51) Int. Cl.
*C10L 1/16* (2006.01)
*C10G 71/00* (2006.01)

(52) U.S. Cl. ..... 508/591; 208/19

(58) Field of Classification Search ..... 508/591; 208/18, 19

See application file for complete search history.

(56) References Cited

U.S. PATENT DOCUMENTS

| | | | | |
|---|---|---|---|---|
| 4,912,272 | A | 3/1990 | Wu | |
| 5,858,935 | A | 1/1999 | Watts et al. | |
| 6,713,438 | B1 * | 3/2004 | Baillargeon et al. | 508/463 |
| 2003/0236177 | A1 | 12/2003 | Wu et al. | |
| 2004/0242441 | A1 * | 12/2004 | Chiu | 508/591 |
| 2006/0135378 | A1 | 6/2006 | Takahashi et al. | |
| 2006/0199743 | A1 | 9/2006 | Rosenbaum et al. | |

FOREIGN PATENT DOCUMENTS

| | | |
|---|---|---|
| JP | 59 89397 | 5/1984 |
| JP | 62 240385 | 10/1987 |
| JP | 1 104695 | 4/1989 |
| JP | 4 502775 | 5/1992 |
| JP | 10 330778 | 12/1998 |
| JP | 2000 501126 | 2/2000 |
| JP | 2005 200447 | 7/2005 |
| JP | 2006 117851 | 5/2006 |
| JP | 2006 117852 | 5/2006 |
| JP | 2006 117853 | 5/2006 |
| JP | 2006 117854 | 5/2006 |
| WO | 2004 074414 | 9/2004 |

OTHER PUBLICATIONS

Supplementary European Search Report dated Mar. 17, 2011.

* cited by examiner

*Primary Examiner* — Walter D Griffin
*Assistant Examiner* — Frank C Campanell
(74) *Attorney, Agent, or Firm* — Oblon, Spivak, McClelland, Maier & Neustadt, L.L.P.

(57) ABSTRACT

A lubricating oil composition of the invention includes a lubricant base oil of which kinematic viscosity at 100 degrees C. is 1 to 5 $mm^2/s$; and at least one component selected from an olefin copolymer (OCP) and a poly-α-olefin (PAO) of which kinematic viscosity at 100° C. is 20 to 2000 $mm^2/s$, a kinematic viscosity of the lubricating oil composition at 100 degrees C. being 8 $mm^2/s$ or less and viscosity index thereof being 155 or more.

14 Claims, No Drawings

LUBRICANT COMPOSITION

TECHNICAL FIELD

The present invention relates to a lubricating oil composition. Specifically, it relates to the lubricating oil composition having a low viscosity and an excellent fatigue life, particularly, suitable for a lubricating oil for an automobile transmission.

BACKGROUND ART

In recent years, there is a growing demand for saving fuel of an automobile due to a global issue of carbon dioxide emission and worldwide increase of energy demand. Under these circumstances, it is more demanded than before to improve a power transmission efficiency of a transmission, and it is also demanded to achieve a high torque capacity of the lubricating oil that is a major constituent component.

Lowering a viscosity of the lubricating oil may be an example as a means for saving fuel of the transmission. Among the transmission, an automatic transmission and a continuously variable transmission for automobiles have a torque converter, a wet clutch, a gear bearing mechanism, an oil pump and a hydraulic control system. Lowering the viscosity used in these transmissions reduces agitation- and frictional resistance, thereby improving the power transmission efficiency to improve fuel consumption of the automobiles.

However, the lubricating oil having the lowered viscosity increases the influence of contact of metals, so that a fatigue life of a machine component such as a bearing and a gear is considerably reduced to cause some malfunctions in the transmissions and the like.

Lubricating oil compositions for transmissions having a long fatigue life while keeping a low viscosity are disclosed in Patent Documents 1 to 4.

Patent Document 1: JP-A-2006-117851
Patent Document 2: JP-A-2006-117852
Patent Document 3: JP-A-2006-117853
Patent Document 4: JP-A-2006-117854

DISCLOSURE OF THE INVENTION

Problems to Be Solved by the Invention

However, since a polymethacrylate (PMA) is used as a viscosity index improver in the lubricating oil compositions disclosed in the above-described Patent Documents 1 to 4, although the viscosity index is improved, an oil film thickness is thinned and an oil film formation performance is deteriorated. In other words, metal frictions are likely to be caused due to the thin oil film, resulting in shortening a fatigue life.

An object of the present invention is to provide a lubricating oil composition that exhibits a low viscosity, a low temperature-dependency of viscosity, an excellent oil film formation performance and a long fatigue life.

Means for Solving the Problems

In order to solve the above-mentioned problems, according to an aspect of the invention, there is provided a lubricating oil composition described below.

(1) The lubricating oil composition includes a lubricant base oil of which kinematic viscosity at 100 degrees C. is 1 to 5 $mm^2/s$; and at least one component selected from olefin copolymer (OCP) and poly-α-olefin (PAO) of which kinematic viscosity at 100 degrees C. is respectively 20 to 2000 $mm^2/s$, the lubricant oil composition of which kinematic viscosity at 100 degrees C. being 8 $mm^2/s$ or less and of which viscosity index being 155 or more.

(2) In the lubricating oil composition described in (1), the olefin copolymer is contained in a range from 1 mass % to 20 mass % of a total amount of the composition.

(3) In the lubricating oil composition described in (1), the poly-α-olefin is contained in a range from 1 mass % to 20 mass % of a total amount of the composition.

(4) The lubricating oil composition described in any one of (1) to (3) is used as a lubricating oil for an automobile transmission.

According to the above aspect of the invention, a lubricating oil composition that has a low viscosity, a low temperature-dependency of viscosity, an excellent oil film formation performance and a long fatigue life can be provided. Particularly, the lubricating oil composition can be effectively used for a transmission under EHL conditions.

BEST MODE FOR CARRYING OUT THE INVENTION

A lubricating oil composition of the invention uses a lubricating base oil having a kinematic viscosity at 100 degrees C. of 1 to 5 $mm^2/s$. When the kinematic viscosity at 100 degrees C. of the lubricating base oil exceeds 5 $mm^2/s$, the lubricating oil composition does not show a desirable viscosity index. Further, power loss due to viscosity resistance is increased, so that fuel consumption is not sufficiently improved. When the kinematic viscosity at 100 degrees C. of the lubricating base oil is less than 1 $mm^2/s$, an oil film is not sufficiently formed to increase friction resistance. Furthermore, an evaporation loss is also increased. The kinematic viscosity at 100 degrees C. of the lubricant base oil is more preferably in a range from 2 $mm^2/s$ to 4.5 $mm^2/s$.

Incidentally, the kinematic viscosity at 100 degrees C. is measured according to JIS K 2283.

The lubricant base oil is not particularly limitative, but any oil typically used as a lubricant base oil can be used irrespective of a mineral oil or a synthetic oil.

Preferably, examples of the mineral oil include paraffinic and naphthenic base oils which can be obtained by subjecting a lubricating oil fraction produced by atmospheric- and vacuum-distillation of a crude oil, to any suitable combination of refining processes selected from solvent-deasphalting, solvent-extracting, hydrocracking, solvent-dewaxing, catalytic-dewaxing, hydrorefining, sulfuric acid treatment and clay treatment.

Examples of the synthetic oil include polybutene, polyol esters, diacid esters, phosphate esters, polyphenyl ethers, alkylbenzenes, alkylnaphthalenes, polyoxyalkylene glycols, neopentyl glycols, silicone oil, trimethylolpropane, pentaerythritol and hindered esters.

The mineral oils and synthetic oils with the kinematic viscosity at 100 degrees C. of 1 to 5 $mm^2/s$ may be used alone or in a mixture of two or more selected from the above base oils at any rate.

The lubricating oil composition of the invention includes at least one of an olefin copolymer (OCP) and a poly-α-olefin (PAO) with a kinematic viscosity at 100 degrees C. of 20 to 2000 $mm^2/s$.

When the kinematic viscosity at 100 degrees C. of OCP exceeds 2000 $mm^2/s$, an oil film is not sufficiently formed to shorten a fatigue life. On the other hand, when the kinematic viscosity at 100 degrees C. is less than 20 $mm^2/s$, a thickness of the oil film is reduced, which is also not preferable. The kinematic viscosity at 100 degrees C. of OCP is more preferably in a range from 100 to 2000 $mm^2/s$.

OCP may be exemplified by ethylene-propylene copolymer and the like.

The content of OCP is preferably in a range from 1 to 20 mass % of a total amount of the composition. The content of OCP can be appropriately determined within the range according to the kinematic viscosity of OCP, the kinematic viscosity and contents of the base oils and contents of other additives. When the content of OCP is less than 1 mass %, a viscosity index improving performance is insufficient for showing a saving-fuel performance. When the content of OCP exceeds 20 mass %, the viscosity of a product is increased to show little saving-fuel performance.

Similarly, when a kinematic viscosity at 100 degrees C. of PAO exceeds 2000 $mm^2/s$, an oil film is not sufficiently formed to shorten a fatigue life. When the kinematic viscosity at 100 degrees C. is less than 20 $mm^2/s$, a thickness of the oil film is reduced, which is also not preferable. The kinematic viscosity at 100 degrees C. of PAO is more preferably in a range from 40 to 1000 $mm^2/s$.

PAO is exemplified by 1-octene oligomer, 1-decene oligomer and the like.

The content of PAO is preferably in a range from 1 to 20 mass % of the total amount of the composition. The content of PAO can be appropriately determined within the range according to the kinematic viscosity of PAO, the kinematic viscosity and contents of the base oils and contents of other additives. When the content of PAO is less than 1 mass %, a viscosity index improving performance is insufficient for showing a saving-fuel performance. When the content of PAO exceeds 20 mass %, the viscosity of a product is increased. Alternatively, when the viscosity of the product is adjusted to a lower viscosity, the viscosity index improving performance is insufficient.

The lubricating oil composition of the invention may include various additives. The various additives are used to show desired characteristics. The additives may be exemplified by an antioxidant, an extreme pressure agent, an antiwear agent, an oiliness agent, a detergent dispersant and a pour point depressant.

The antioxidant may be exemplified by an amine antioxidant, a phenolic antioxidant and a sulfuric antioxidant.

Examples of the amine antioxidant include: monoalkyldiphenylamines such as monooctyldiphenylamine and monononyldiphenylamine; dialkyldiphenylamines such as 4,4'-dibutyldiphenylamine, 4,4'-dipentyldiphenylamine, 4,4'-dihexyldiphenylamine, 4,4'-diheptyldiphenylamine, 4,4'-dioctyldiphenylamine and 4,4'-dinonyldiphenylamine; polyalkyldiphenylamines such as tetrabutyldiphenylamine, tetrahexyldiphenylamine, tetraoctyldiphenylamine and tetranonyldiphenylamine; and naphthylamines such as α-naphthylamine, phenyl-αc-naphthylamine, butylphenyl-α-naphthylamine, pentylphenyl-α-naphthylamine, hexylphenyl-α-naphthylamine, heptylphenyl-α-naphthylamine, octylphenyl-α-naphthylamine and nonylphenyl-α-naphthylamine. Among these, the dialkyldiphenylamines are particularly preferable.

Examples of the phenolic antioxidant include: monophenols such as 2,6-di-tert-butyl-4-methylphenol and 2,6-di-tert-butyl-4-ethylphenol; diphenols such as 4,4'-methylenebis(2,6-di-tert-butylphenol) and 2,2'-methylenebis(4-ethyl-6-tert-butylphenol).

Examples of the sulfuric antioxidant include: phenothiazine; pentaerythritol-tetrakis(3-lauryl-thiopropionate); bis(3,5-di-tert-butyl-4-hydroxybenzyl)sulfide; thiodiethylenebis(3-(3,5-di-tert-butyl-4-hydroxypheny))propionate; and 2,6-di-tert-butyl-4-(4,6-bis(octylthio)-1,3,5-triazine-2-methylamino)phenol.

These antioxidants may be used alone or in combination of two or more. The content of the antioxidants is typically selected in a range from 0.01 to 10 mass % of the total amount of the lubricating oil composition, preferably in the range from 0.03 to 5 mass %.

Examples of the extreme pressure agent, antiwear agent and oiliness agent include an organic metal compound such as zinc dithiopliosl)hate (ZnDTP), zinc dithiocarbamate (ZnDTC), sulfurized oxymolybdenum organophosphorodithioate (MODTP) and sulfurized oxymolybdenum dithiocarbamate (MoDTC). The contents of these compounds are typically in the range from 0.05 to 5 mass % of the total amount of the lubricating oil composition, preferably in the range from 0.1 to 3 mass %.

Examples of the oiliness agent include: saturated and unsaturated aliphatic monocarboxyl acids such as stearic acid and oleic acid; dimerized aliphatic acids such as dimer acid and hydrogenated dimer acid; hydroxy aliphatic acids such as ricinoleic acid and 12-hydroxystearic acid; saturated and unsaturated aliphatic monoalcohols such as lauryl alcohol and oleyl alcohol; saturated and unsaturated aliphatic monoamines such as stearylamine and oleylamine; saturated and unsaturated aliphatic monocarboxyl acid amide such as lauric acid amide and oleic acid amide; and the like.

The contents of the oiliness agents are preferably in a range from 0.01 to 10 mass % of the total amount of the lubricating oil composition, particularly preferably from 0.1 to 5 mass %.

Examples of the detergent dispersant include: an ashless dispersant such as succinimides; boron containing succinimides, benzylamines, boron containing benzylamines, succinates and mono- or di-carboxylic acid amides typified by aliphatic acid and succinic acid; and a metal detergent such as neutral metal sulfonates, neutral metal phenates, neutral metal salicylates, neutral metal phosphonates, basic sulfonates, basic phenates, basic salicylates, overbased sulfonates, overbased salicylates and overbased phosphonates. The contents of the detergent dispersants are typically in a range from 0.1 to 20 mass % of the total amount of the lubricating oil composition, preferably in the range from 0.5 to 10 mass %.

The pour point depressant is exemplified by polymethacrylates having a weight-average molecular weight of 50,000 to 150,000.

The lubricating oil composition of the invention may contain an additive other than the above-described such as a rust inhibitor, a metal deactivator, an antifoaming agent and a surfactant as necessary.

The rust inhibitor is exemplified by alkenyl succinates and partial esters thereof The metal anticorrosive agent is exemplified by benzotriazoles, benzimidazoles, benzothiazoles, and thiadiazoles. The metal deactivator is exemplified by benzotriazoles and derivatives thereof, benzothiazole and derivatives thereof, triazoles and derivatives thereof, dithiocarbamates and derivatives thereof and imidazoles and derivatives thereof The antifoaming agent is exemplified by dimethylpolysiloxanes and polyacrylates. The surfactant is exemplified by polyoxyethylene alkylphenyl ethers and the like.

The total contents of these various additives are prepared to be typically in a range from 0.1 to 20 mass % of the total amount of the lubricating oil composition, preferably in the range from 5 to 15 mass %.

The lubricating oil composition prepared in the above combination preferably has the kinematic viscosity at 100 degrees C. of 8.0 $mm^2/s$ or less, more preferably 6.5 $mm^2/s$ or less, further more preferably 5.8 $mm^2/s$ or less. When the kinematic viscosity at 100 degrees C. exceeds 8.0 $mm^2/s$, frictional resistance increases due to the high viscosity, thereby reducing a power transmission efficiency.

A viscosity index of the lubricating oil composition is 155 or more, more preferably 160 or more. When the viscosity index is less than 155, the temperature-dependency of viscosity increases, which is not preferable.

Thus, the added contents of the lubricating base oil and OCP or PAO are adjusted so that the kinematic viscosity at 100 degrees C. of the lubricating oil composition is 8.0 $mm^2/s$ or less and the viscosity index is 155 or more, the lubricating oil composition containing the lubricating base oil with the kinematic viscosity at 100 degrees C. of 1 to 5 $mm^2/s$, an olefin copolymer (OCP) or a poly-α-olefin (PAO) with the kinematic viscosity at 100 degrees C. of 20 to 2000 $mm^2/s$, and the additive. The lubricating base oil thus adjusted is also excellent in oil film formation performance. Accordingly, metal frictions are unlikely to be caused, resulting in lengthening a fatigue life.

In other words, the lubricating oil composition that has a low viscosity, a low temperature-dependency of viscosity, an excellent oil film formation performance and a long fatigue life can be provided.

EXAMPLES

Next, the invention will be further described in detail with Examples, which by no means limit scope of the invention.

Examples A1 to C7 and Comparatives A1 to C6

A lubricating oil composition was prepared according to compositions set forth in Table 1. The prepared lubricating oil compositions were measured in a kinematic viscosity at 100 degrees C., a viscosity index and a film thickness according to the following methods.

[Kinematic Viscosity at 100 degrees C.]

The kinematic viscosity was measured according to JIS K 2283.

[Viscosity Index (VI)]

The viscosity index was measured according to JIS K 2283.

[Film Thickness]

The film thickness was measured using EHL Ultra Thin Film Measurement System manufactured by PCS Instruments. This system can measure a film thickness of 1 to 250 nm.

The results of Examples and Comparatives measured according to the above methods are respectively shown in Tables 1 and 2.

TABLE 1

| | | UNIT | KINEMATIC VISCOSITY @100° C. ($mm^2/s$) | EXAMPLE A1 | EXAMPLE A2 | EXAMPLE B1 | EXAMPLE B2 | EXAMPLE B3 |
|---|---|---|---|---|---|---|---|---|
| COMPOSITION | BASE OIL 1 | MASS % | 2.22 | 36.5 | 37.4 | 38.0 | — | 38.4 |
| | BASE OIL 2 | | 2.76 | | | — | 83.3 | — |
| | BASE OIL 3 | | 4.28 | 44.5 | 45.5 | 46.4 | — | 46.9 |
| | BASE OIL 4 | | 30.9 | | | — | — | — |
| | PAO 1 | | 5.8 | — | — | — | — | — |
| | PAO 2 | | 8 | — | — | — | — | — |
| | PAO 3 | | 9.8 | — | — | — | — | — |
| | PAO 4 | | 40 | — | — | — | — | — |
| | PMA 1 | | 520 | — | — | — | — | — |
| | PMA 2 | | 490 | — | — | — | — | — |
| | PMA 3 | | 850 | — | — | — | — | — |
| | PMA 4 | | 830 | — | — | — | — | — |
| | OCP 1 | | 20 | — | — | — | — | — |
| | OCP 2 | | 40 | — | — | — | — | — |
| | OCP 3 | | 100 | — | — | — | — | — |
| | OCP 4 | | 400 | — | — | — | — | — |
| | OCP 5 | | 600 | 7.0 | — | 3.7 | 2.7 | — |
| | OCP 6 | | 2000 | — | 5.1 | — | 2.0 | 2.7 |
| | OCP 7 | | 3000 | — | — | — | — | — |
| | OCP 8 | | 4000 | — | — | — | — | — |
| | ADDITIVE | | — | 12.0 | 12.0 | 12.0 | 12.0 | 12.0 |
| | TOTAL | | — | 100.0 | 100.0 | 100.0 | 100.0 | 100.0 |
| CHARACTERISTICS | KINEMATIC VISCOSITY @100° C. | $mm^2/s$ | — | 7.40 | 7.40 | 5.80 | 5.79 | 5.79 |
| | VISCOSITY INDEX | — | — | 166 | 168 | 158 | 159 | 159 |
| | FILM THICKNESS | nm | — | 17.8 | 17.7 | 15.1 | 15.1 | 15.3 |

| | | EXAMPLE C1 | EXAMPLE C2 | EXAMPLE C3 | EXAMPLE C4 | EXAMPLE C5 | EXAMPLE C6 | EXAMPLE C7 |
|---|---|---|---|---|---|---|---|---|
| COMPOSITION | BASE OIL 1 | — | — | — | — | — | — | — |
| | BASE OIL 2 | 72.4 | 70.8 | 75.7 | 79.6 | 82.5 | 83.3 | 84.5 |
| | BASE OIL 3 | — | — | — | — | — | — | — |
| | BASE OIL 4 | — | — | — | — | — | — | — |
| | PAO 1 | — | — | — | — | — | — | — |
| | PAO 2 | — | — | — | — | — | — | — |
| | PAO 3 | — | — | — | — | — | — | — |
| | PAO 4 | 15.6 | — | — | — | — | — | — |
| | PMA 1 | — | — | — | — | — | — | — |

TABLE 1-continued

| | | | | | | | | |
|---|---|---|---|---|---|---|---|---|
| | PMA 2 | — | — | — | — | — | — | — |
| | PMA 3 | — | — | — | — | — | — | — |
| | PMA 4 | — | — | — | — | — | — | — |
| | OCP 1 | — | 17.2 | — | — | — | — | — |
| | OCP 2 | — | — | 12.3 | — | — | — | — |
| | OCP 3 | — | — | — | 8.5 | — | — | — |
| | OCP 4 | — | — | — | — | 5.5 | — | — |
| | OCP 5 | — | — | — | — | — | 4.7 | — |
| | OCP 6 | — | — | — | — | — | — | 3.5 |
| | OCP 7 | — | — | — | — | — | — | — |
| | OCP 8 | — | — | — | — | — | — | — |
| | ADDITIVE | 12.0 | 12.0 | 12.0 | 12.0 | 12.0 | 12.0 | 12.0 |
| | TOTAL | 100.0 | 100.0 | 100.0 | 100.0 | 100.0 | 100.0 | 100.0 |
| CHARACTERISTICS | KINEMATIC VISCOSITY @100° C. | 5.50 | 5.50 | 5.50 | 5.49 | 5.53 | 5.49 | 5.50 |
| | VISCOSITY INDEX | 159 | 158 | 161 | 164 | 169 | 170 | 171 |
| | FILM THICKNESS | 15.0 | 14.8 | 14.9 | 15.1 | 15.1 | 15.2 | 15.4 |

TABLE 2

| | | UNIT | KINEMATIC VISCOSITY @100° C. ($mm^2/s$) | COMPARATIVE A1 | COMPARATIVE A2 | COMPARATIVE B1 | COMPARATIVE B2 |
|---|---|---|---|---|---|---|---|
| COMPOSITION | BASE OIL 1 | Mass % | 2.22 | 35.7 | 37.8 | 37.5 | 38.6 |
| | BASE OIL 2 | | 2.76 | | | — | — |
| | BASE OIL 3 | | 4.28 | 43.5 | 46.0 | 45.8 | 47.2 |
| | BASE OIL 4 | | 30.9 | | | — | — |
| | PAO 1 | | 5.8 | — | — | — | — |
| | PAO 2 | | 8 | — | — | — | — |
| | PAO 3 | | 9.8 | — | — | — | — |
| | PAO 4 | | 40 | — | — | — | — |
| | PMA 1 | | 520 | — | — | — | — |
| | PMA 2 | | 490 | — | — | — | — |
| | PMA 3 | | 850 | 8.2 | — | — | — |
| | PMA 4 | | 830 | 0.6 | — | 4.7 | — |
| | OCP 1 | | 20 | — | — | — | — |
| | OCP 2 | | 40 | — | — | — | — |
| | OCP 3 | | 100 | — | — | — | — |
| | OCP 4 | | 400 | — | — | — | — |
| | OCP 5 | | 600 | — | — | — | — |
| | OCP 6 | | 2000 | — | — | — | — |
| | OCP 7 | | 3000 | — | 4.2 | — | 2.2 |
| | OCP 8 | | 4000 | — | — | — | — |
| | ADDITIVE | | — | 12.0 | 12.0 | 12.0 | 12.0 |
| | TOTAL | | — | 100.0 | 100.0 | 100.0 | 100.0 |
| CHARACTERISTICS | KINEMATIC VISCOSITY @100° C. | $mm^2/s$ | — | 7.36 | 7.40 | 5.80 | 5.81 |
| | VISCOSITY INDEX | — | — | 205 | 169 | 182 | 174 |
| | FILM THICKNESS | nm | — | 15.2 | 15.7 | 10.2 | 12.4 |

| | | COMPARATIVE C1 | COMPARATIVE C2 | COMPARATIVE C3 | COMPARATIVE C4 | COMPARATIVE C5 | COMPARATIVE C6 |
|---|---|---|---|---|---|---|---|
| COMPOSITION | BASE OIL 1 | — | — | — | — | — | — |
| | BASE OIL 2 | 80.2 | 78.1 | 81.6 | 83.7 | 85.1 | 84.4 |
| | BASE OIL 3 | — | — | — | — | — | — |
| | BASE OIL 4 | — | — | — | — | — | — |
| | PAO 1 | — | — | — | — | — | — |
| | PAO 2 | — | — | — | — | — | — |
| | PAO 3 | — | — | — | — | — | — |
| | PAO 4 | — | — | — | — | — | — |
| | PMA 1 | 7.8 | — | — | — | — | — |
| | PMA 2 | — | 9.9 | — | — | — | — |
| | PMA 3 | — | — | 6.4 | — | — | — |
| | PMA 4 | — | — | — | 4.3 | — | — |
| | OCP 1 | — | — | — | — | — | — |
| | OCP 2 | — | — | — | — | — | — |
| | OCP 3 | — | — | — | — | — | — |

TABLE 2-continued

| | | | | | | | |
|---|---|---|---|---|---|---|---|
| | OCP 4 | — | — | — | — | — | — |
| | OCP 5 | — | — | — | — | — | — |
| | OCP 6 | — | — | — | — | — | — |
| | OCP 7 | — | — | — | — | 2.9 | — |
| | OCP 8 | — | — | — | — | — | 3.6 |
| | ADDITIVE | 12.0 | 12.0 | 12.0 | 12.0 | 12.0 | 12.0 |
| | TOTAL | 100.0 | 100.0 | 100.0 | 100.0 | 100.0 | 100.0 |
| CHARACTERISTICS | KINEMATIC VISCOSITY @100° C. | 5.49 | 5.51 | 5.51 | 5.47 | 5.51 | 5.49 |
| | VISCOSITY INDEX | 195 | 204 | 204 | 216 | 174 | 175 |
| | FILM THICKNESS | 12.9 | 11.2 | 9.9 | 10.2 | 11.9 | 10.0 |

In Examples and Comparatives, a paraffinic base oil in Group II stipulated in API (American Petroleum Institute) was used as the base oil and a product name "Infineum T4261" manufactured by Infineum International Ltd. was used as an additive.

Commercially available non-dispersion OCP and PMA, and a commercially available PAO were used.

As shown in Tables 1 and 2, the film thickness in Examples A1 and A2 using OCP is thicker than that in Comparatives A1 and A2 using PMA, which shows that the Examples A1 and A2 are excellent in oil film formation performance.

As can be recognized by comparing Examples B1 to B3 in Table 1 and Comparatives B1 and B2 in Table 2, Examples B1 to B3 in Table 1 are superior in oil film formation performance.

As can be recognized by comparing Examples C1 to C7 in Table 1 and Comparatives C1 and C6 in Table 2, Examples C1 to C7 in Table 1 are superior in oil film formation performance.

In Examples A1, A2, B1 to B3 and C1 to C7, the kinematic viscosity is as low as at 8.0 $mm^2/s$ or less and the viscosity index is also desirable.

The invention claimed is:

1. A lubricating oil composition, comprising:

a lubricant base oil of which kinematic viscosity at 100 degrees C. is 1 to 5 $mm^2/s$; and at least one component selected from the group consisting of an olefin copolymer (OCP) of which kinematic viscosity at 100 degrees C. is 20 to 2000 $mm^2/s$ and a poly-α-olefin (PAO) of which kinematic viscosity at 100 degrees C. is 20 to 2000 $mm^2/s$, wherein the lubricating oil composition has a kinematic viscosity at 100 degrees C. of 6.5 $mm^2/s$ or less and a viscosity index of 155 or more.

2. The lubricating oil composition according to claim 1, wherein the lubricating oil composition comprises the olefin copolymer in a range from 1 to 20 mass % of a total amount of the composition.

3. The lubricating oil composition according to claim 1, wherein the lubricating oil composition comprises the poly-α-olefin in a range from 1 mass % to 20 mass % of a total amount of the composition.

4. The lubricating oil composition according to claim 1, wherein the lubricating oil composition is used as a lubricating oil for an automobile transmission.

5. The lubricating oil composition according to claim 1, wherein the lubricating base oil has a kinematic viscosity at 100 degrees C. of from 2 $mm^2/s$ to 4.5 $^2/s$.

6. The lubricating oil composition according to claim 1, comprising an olefin copolymer (OCP) of which kinematic viscosity at 100 degrees C. is 20 to 2000 $mm^2/s$.

7. The lubricating oil composition according to claim 1, comprising an olefin copolymer (OCP) of which kinematic viscosity at 100 degrees C. is 100 to 2000 $mm^2/s$.

8. The lubricating oil composition according to claim 1, comprising olefin copolymer (OCP) of which kinematic viscosity at 100 degrees C. is 20 to 2000 $mm^2/s$ in an amount of from 1 to 20 mass %.

9. The lubricating oil composition according to claim 1, comprising a poly-α-olefin (PAO) of which kinematic viscosity at 100 degrees C. is 20 to 2000 $mm^2/s$.

10. The lubricating oil composition according to claim 1, comprising a poly-α-olefin (PAO) of which kinematic viscosity at 100 degrees C. is 20 to 2000 $mm^2/s$ in an amount 1 to 20 mass %.

11. The lubricating oil composition according to claim 1, further comprising an antioxidant.

12. The lubricating oil composition according to claim 11, wherein the antioixdant is an amine antioxidant, a phenolic antioxidant, a sulfuric antioxidant, or combination thereof.

13. The lubricating oil composition according to claim 1, which has a kinematic viscosity at 100 degrees C. of 5.8 $mm^2/s$ or less.

14. A method of lubricating an automobile transmission, the method comprising providing the lubricating oil composition according to claim 1 to the automobile transmission.

* * * * *